US007930899B2

(12) United States Patent
Lyun-Su

(10) Patent No.: US 7,930,899 B2
(45) Date of Patent: Apr. 26, 2011

(54) ACCUMULATOR OF REFRIGERATION CYCLE SYSTEM

(75) Inventor: Kim Lyun-Su, Daegu (KR)

(73) Assignee: LG Electronics Inc., Seoul (KR)

( * ) Notice: Subject to any disclaimer, the term of this patent is extended or adjusted under 35 U.S.C. 154(b) by 282 days.

(21) Appl. No.: 11/434,152

(22) Filed: May 16, 2006

(65) Prior Publication Data

US 2007/0062214 A1 Mar. 22, 2007

(30) Foreign Application Priority Data

May 18, 2005 (KR) ..... 10-2005-0041811

(51) Int. Cl.
*F25B 43/00* (2006.01)
*F25B 43/02* (2006.01)

(52) U.S. Cl. ..... 62/503; 62/471; 62/512; 137/171

(58) Field of Classification Search ..... 62/83, 174, 62/471, 503, 512; 137/171–204
See application file for complete search history.

(56) References Cited

U.S. PATENT DOCUMENTS 2,623,607 A * 12/1952 Bottum ..... 62/474
2,990,698 A * 7/1961 Crotser ..... 62/503
3,077,086 A * 2/1963 Japhet ..... 62/324.3
3,283,524 A * 11/1966 Thomson ..... 62/115
3,370,440 A * 2/1968 Kellie ..... 62/503
3,540,230 A * 11/1970 Evans ..... 62/471
3,600,904 A * 8/1971 Tilney ..... 62/136
4,776,183 A * 10/1988 Okoma ..... 62/503
5,075,967 A * 12/1991 Bottum ..... 29/890.06
5,493,875 A * 2/1996 Kozinski ..... 62/503
5,722,146 A * 3/1998 Seigle et al. ..... 29/446
5,996,372 A * 12/1999 Koda et al. ..... 62/503
6,467,300 B1 * 10/2002 Noble, III ..... 62/472
6,701,745 B1 * 3/2004 Kozinski ..... 62/503
6,901,763 B2 * 6/2005 Memory et al. ..... 62/113
7,013,907 B2 * 3/2006 Ryabtsev et al. ..... 137/198

FOREIGN PATENT DOCUMENTS

JP 02126060 A * 5/1990
JP 02140571 A * 5/1990

OTHER PUBLICATIONS

JP 02126060 Abstract May 1990, Japan, Kazuo Sekigami.*

* cited by examiner

*Primary Examiner* — Ljiljana (Lil) V Ciric
*Assistant Examiner* — Filip Zec
(74) *Attorney, Agent, or Firm* — Ked & Associates LLP

(57) ABSTRACT

An accumulator is provided which is installed between a compressor and an evaporator of a refrigeration cycle system. The accumulator includes an inlet pipe through which refrigerant is introduced from the evaporator, an outlet pipe through which the evaporated refrigerant is delivered to the compressor, and a chamber which is connected to the inlet and outlet pipes and formed with a floor surface at a lower level than connecting portions of the chamber connected to the inlet and outlet pipes. Further, the inlet and outlet pipes are horizontally connected to the chamber.

8 Claims, 3 Drawing Sheets

ACCUMULATOR OF REFRIGERATION CYCLE SYSTEM

BACKGROUND OF THE INVENTION

1. Field of Invention

The present invention relates to an accumulator for preventing a liquid refrigerant, which has not been evaporated in an evaporator of a refrigeration cycle system used in a refrigerator, an air conditioner or the like, from being introduced into a compressor, and more particularly, to an accumulator configured to be easily installed and to allow noise to be generated at a minimum level.

2. Description of the Prior Art

A refrigeration cycle system is provided in a machine for generating cold air such as a refrigerator or an air conditioner. In general, the refrigeration cycle system comprises a compressor for compressing a gas refrigerant to high temperature and high pressure, a condenser for converting the high-temperature and high-pressure gas refrigerant compressed in the compressor into a normal-temperature and high-pressure liquid refrigerant, a capillary for converting the normal-temperature and high-pressure liquid refrigerant into a low-temperature and low-pressure liquid refrigerant, and an evaporator for converting the low-temperature and low-pressure liquid refrigerant into a gas refrigerant and simultaneously absorbing surrounding heat. Since the liquid refrigerant evaporates in the evaporator while absorbing the surrounding heat, the air around the evaporator can be changed into cold air, which in turn supplied to predetermined portions where the cold air is required.

Further, an accumulator is installed between the evaporator and the compressor. The accumulator serves to prevent the liquid refrigerant, which has not been evaporated in the evaporator, from being introduced into the compressor.

The refrigeration cycle system operates the compressor and circulates the refrigerant to perform the refrigeration function. At this time, the cooling efficiency is enhanced when a high-pressure refrigerant is fully evaporated and then introduced into the compressor. Thus, the accumulator for preventing the unevaporated liquid refrigerant from being introduced into the compressor plays an important role in improving the performance of the chiller.

FIG. 1 is a sectional view of an accumulator applied to a conventional refrigeration cycle system.

As shown in the figure, a longitudinal outlet pipe 1 connected to a compressor is provided on an upper portion of a conventional accumulator. Further, a chamber 3 which is formed integrally with the outlet pipe 1 and has a predetermined space for storing liquid refrigerant therein is formed below the outlet pipe 1. A lower end of the chamber 3 is connected to an inlet pipe 5 through which the refrigerant is introduced from an evaporator. Further, an upper end of the inlet pipe 5 placed in the chamber 3 is bent at a predetermined angle. In addition, an oil recovery hole 7 is formed at a portion of the inlet pipe 5 corresponding to the lower end of the chamber 3.

In the conventional accumulator so configured, the gas and liquid refrigerants which are respectively evaporated and not evaporated while passing through the evaporator when the compressor is operated are introduced into the chamber 3 through the inlet pipe 5. Here, the gas refrigerant is discharged through the outlet pipe 1 to the compressor, whereas the unevaporated liquid refrigerant stays in the chamber 3.

At this time, when the operation of the compressor stops, oil and the unevaporated liquid refrigerant staying in the chamber 3 of the accumulator is introduced again into the evaporator through the oil recovery hole 7 formed in the inlet pipe 5 placed in the chamber 3. At this time, some of the gas refrigerant evaporated in the evaporator is introduced into the chamber 3 through the oil recovery hole 7 and rises through the liquid refrigerant staying in the chamber 3 to thereby generate bubbles.

However, the aforementioned prior art has the following problems.

The aforementioned related art accumulator can be installed only in a longitudinal direction due to the vertical configuration required for separating the gas and liquid refrigerants from each other. Therefore, there is a problem in that spatial restrictions are imposed when the accumulator is installed Further, since a portion of the refrigerant evaporated in the evaporator flows out through the oil recovery hole 7 while flowing along the inlet pipe 5, there is a problem in that bubbles are generated in the liquid refrigerant staying in the chamber 3 to thereby generate noise. Further, when the bubbles are generated as described above, the liquid refrigerant can be substantially prevented from being recovered to the evaporator through the oil recovery hole 7. Therefore, there is a problem in that the recovery rate of liquid refrigerant is lowered in the conventional accumulator.

SUMMARY OF THE INVENTION

Accordingly, the present invention is conceived to solve the aforementioned problems in the prior art. An object of the present invention is to provide an accumulator which can be installed in a horizontal direction.

Another object of the present invention is to provide an accumulator which suppresses the generation of bubbles to minimize noise and has high recovery rate of liquid refrigerant.

A further object of the present invention is to provide an accumulator which allows the positions of outlet and inlet pipes thereof and the flow direction of refrigerant to be easily confirmed from the outside such that it can be easily installed.

According to an aspect of the present invention for achieving the objects, there is provided an accumulator installed between a compressor and an evaporator of a refrigeration cycle system. The accumulator of the present invention comprises an inlet pipe through which refrigerant is introduced from the evaporator, an outlet pipe through which the evaporated refrigerant is delivered to the compressor, and a chamber connected to the inlet and outlet pipes and formed with a floor surface at a lower level than connecting portions of the chamber connected to the inlet and outlet pipes.

Preferably, the inlet and outlet pipes are horizontally connected to the chamber.

The outlet pipe is preferably connected to the chamber in a state where an end thereof is inserted in the chamber. More preferably, the end of the outlet pipe inserted in the chamber is bent upward.

Further, a direction indicating line may be provided on the outside of the chamber to indicate a flow direction of the refrigerant.

The accumulator of the present invention may further comprise a recovery pipe for allowing the floor surface of the chamber and the inlet pipe to communicate with each other. At this time, at least one portion of the recovery pipe is formed to be at a lower level than a portion of the inlet pipe connected to the recovery pipe.

According to the present invention, the accumulator can be installed substantially in a horizontal direction and be operated silently since bubbles are not generated. The liquid refrigerant can be very smoothly recovered to the evaporator.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE PREFERRED EMBODIMENT

Hereinafter, an accumulator of a refrigeration cycle system according to preferred embodiments of the present invention will be described in detail with reference to the accompanying drawings.

Figure 1:
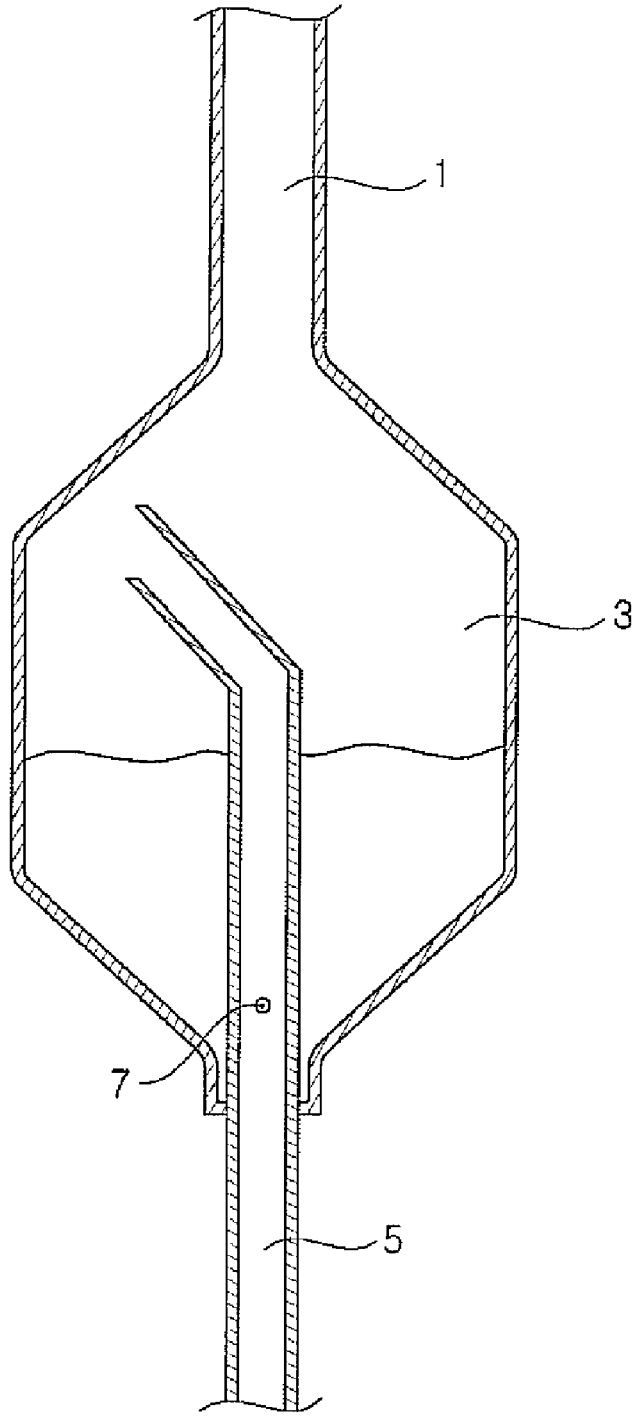
FIG. 1 Conventional Art
FIG. 1 is a sectional view of a conventional accumulator.
Figure 2:
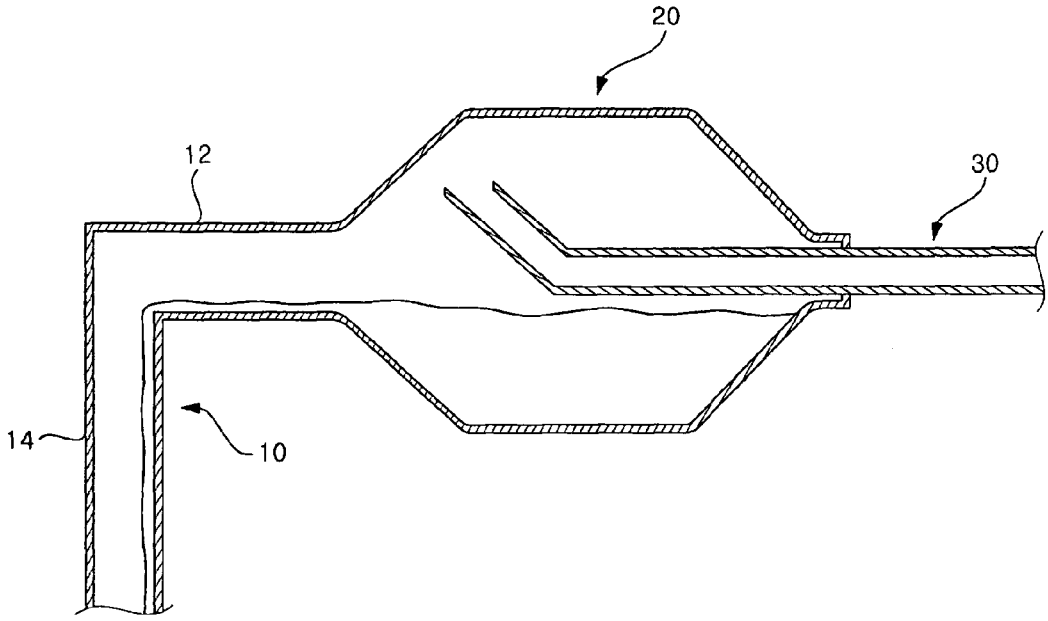
FIG. 2 is a sectional view of an accumulator according to a preferred embodiment of the present invention.

FIG. 2 is a sectional view of an accumulator according to a first preferred embodiment of the present invention. As shown in the figure, the accumulator of the present invention includes an inlet pipe 10 through which a refrigerant is introduced from an evaporator. The refrigerant from the evaporator flows through the inlet pipe 10.

The inlet pipe 10 is connected to a chamber 20 installed in a horizontal orientation. The inlet pipe 10 connected to the chamber 20 includes a chamber connecting portion 12 connected substantially horizontally to one end of the chamber 20 and an evaporator connecting portion 14 extending downwardly from the chamber connecting portion 12 and connected to the evaporator.

A predetermined space is defined within the chamber 20. The other end of the chamber 20 is connected to an outlet pipe 30. The outlet pipe 30 is connected to a compressor. An end of the outlet pipe 30 placed in the chamber 20 is bent upward. Thus, the evaporated gas refrigerant among the refrigerant introduced into the chamber 20 through the inlet pipe 10 is introduced into the compressor through the outlet pipe 30 and the unevaporated liquid refrigerant still stays in the chamber 20.

Here, a floor surface of the chamber 20 is formed to be at a lower level than a portion of the chamber connected to the inlet pipe 10. Further, the unevaporated liquid refrigerant and oil remain in the chamber 20. The unevaporated refrigerant stays in the chamber 20 until the refrigerant reaches a certain level. When the refrigerant reaches the certain level, the unevaporated liquid refrigerant and the oil flow into the evaporator through the inlet pipe 10.

A direction indicating line such as an arrow indicating the refrigerant flowing direction from the inlet pipe 10 to the outlet pipe 30 is marked on the outside of the chamber 20. Such a direction indicating line shows the installation direction of the accumulator, and thus, the accumulator can be more easily assembled.

According to the illustrated embodiment, it can be understood that the portions of the chamber 20 connected respectively to the inlet pipe 10 and the outlet pipe 30 are in a substantially horizontal state. Further, the floor surface of the chamber 20 is formed to be at a lower level than the connecting portions connected to the inlet pipe 10 and the outlet pipe 30. Therefore, the liquid refrigerant can be stored in the chamber 20. In addition, since the end of the outlet pipe 30 placed in the chamber 20 is bent substantially upward, it is possible to selectively supply the compressor with only the liquid refrigerant among the refrigerant introduced into the chamber 20.

Hereinafter, the operation of an accumulator of a refrigeration cycle system according to the present invention will be described in detail according to a flow path along which the refrigerant flows.

The refrigerant absorbs heat from the evaporator and is then converted from a liquid state to a gas state. The evaporated refrigerant is delivered to the chamber 20 through the inlet pipe 10. The refrigerant introduced into the chamber 20 is in a state where the evaporated gas refrigerant and the unevaporated liquid refrigerant are mixed to each other.

The unevaporated liquid refrigerant among the refrigerant introduced into the chamber 20 stays on the floor surface of the chamber 20 together with oil. The evaporated gas refrigerant in the chamber 20 is sucked up into the outlet pipe 30 by means of a suction force of the compressor. On the other hand, the liquid refrigerant continues to stay on the floor surface of the chamber 20. Then, when the liquid refrigerant and oil reaches a certain level corresponding to the connecting portion of the chamber connected to the inlet pipe 10, the refrigerant and oil flow smoothly into the evaporator through the inlet pipe 10. The liquid refrigerant introduced into the evaporator through the inlet pipe 10 absorbs heat again to be evaporated into a gas refrigerant. Then, the aforementioned processes are repeated.

The present invention is configured in such a manner that the connecting portions where the inlet pipe 10 and the outlet pipe 30 are connected to the chamber 20 are in a horizontal state. Further, the floor surface of the chamber 20 is positioned at a lower level than the connecting portions between the pipes 10 and 30 and the chamber 20. Therefore, the evaporated refrigerant among the refrigerant introduced into the chamber 20 is supplied to the compressor through the outlet pipe 30 and the liquid refrigerant staying in the chamber is returned to the evaporator through the inlet pipe 10. Accordingly, it can also be understood that it is possible not only to smoothly return the evaporated refrigerant to the compressor but also to install the accumulator in a horizontal state for the purpose of easy design change and installation and to prevent bubbles and noise from being generated when the evaporated refrigerant is introduced into the chamber.

Hereinafter, a second embodiment of the present invention will be described with reference to FIG. 3. Herein, the same reference numerals are given to the same elements as the previous embodiment and the repeated descriptions on the same elements will be omitted.

Figure 3:
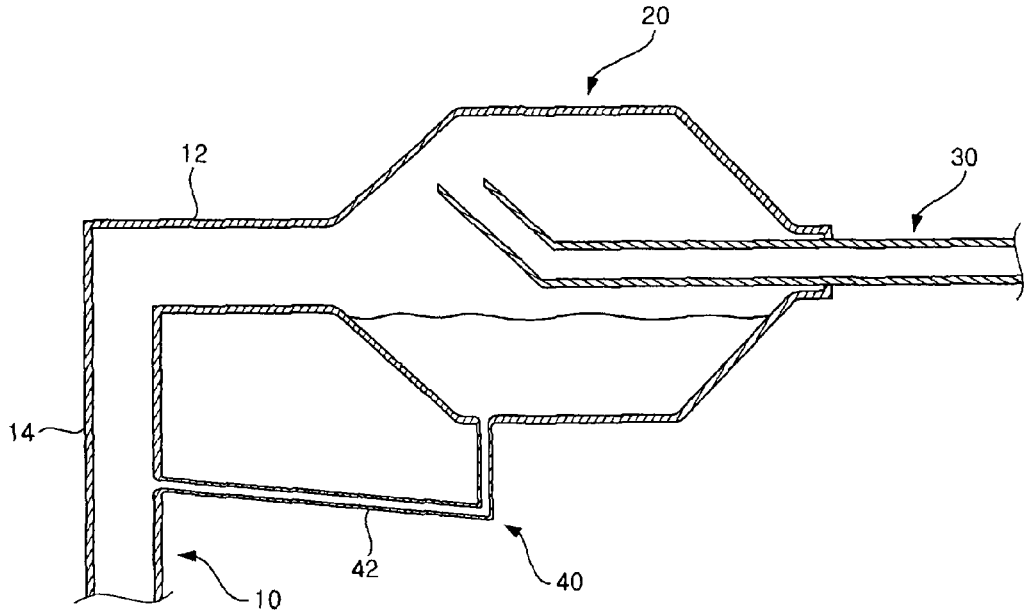
FIG. 3 is a sectional view of an accumulator according to another embodiment of the present invention.

An accumulator according to the embodiment shown in FIG. 3 further comprises a recovery pipe 40 that causes the floor surface of the chamber 20 and the inlet pipe 10 to communicate with each other. The recovery pipe 40 serves to directly deliver the liquid refrigerant in the chamber 20 to the evaporator through the inlet pipe 10. At this time, it is undesirable that the refrigerant evaporated in the evaporator is introduced into the chamber 20 through the recovery pipe 40, because it may cause the bubbling phenomenon or hinder the liquid refrigerant from being recovered as described in the prior art. Therefore, at least one portion 42 of the recovery pipe 40 should be formed to be at a lower level than a connecting portion of the inlet pipe 10 to the recovery pipe 40.

In such a refrigeration cycle system of this embodiment of the present invention, the evaporated gas refrigerant and the unevaporated liquid refrigerant are together introduced from the evaporator into the chamber 20 through the inlet pipe 10. In the chamber 20, the evaporated refrigerant is supplied to the compressor through the outlet pipe 30 and the unevaporated liquid refrigerant staying in the chamber is returned to the evaporator through the recovery pipe 40. The accumulator of this embodiment can also be installed in a horizontal state and allows the bubbling phenomenon not to occur in the chamber.

According to the present invention described above, it is an essential technical spirit that the chamber of the accumulator is connected to the inlet and outlet pipes at a horizontal state and formed with a floor surface at a lower level than the inlet and outlet pipes.

According to the accumulator of the present invention described in detail as above, the following advantages can be expected.

Since the accumulator can be horizontally installed, it is possible to utilize an installation space efficiently and simultaneously to expect working convenience when intending to install the refrigeration cycle system. Further, since the gas refrigerant evaporated in the evaporator does not pass through the liquid refrigerant or oil staying in the chamber, it is possible to prevent bubbles and thus noise from being generated. In addition, since the liquid refrigerant can be easily returned to the evaporator via an inlet pipe as the level of liquid refrigerant staying in the chamber is raised, the liquid refrigerant can be substantially easily recovered. Furthermore, since the direction indicating line is marked on the outside of the chamber of the present invention, the flow direction of the refrigerant can be easily confirmed. Accordingly, since the positions of the inlet and outlet pipes can be easily confirmed, the accumulator can be easily installed.

The scope of the present invention is not limited to the embodiments described and illustrated above but is defined by the appended claims. It will be apparent to those skilled in the art that various modifications and changes can be made thereto within the scope of the invention defined by the claims.

What is claimed is:

1. An accumulator installed between a compressor and an evaporator of a refrigeration cycle system, the accumulator comprising:

an inlet pipe through which a refrigerant is introduced from the evaporator; said inlet pipe connecting the evaporator and the accumulator;

an outlet pipe through which the evaporated refrigerant is delivered to the compressor; said outlet pipe connecting the accumulator and the compressor;

a chamber connected to the inlet and outlet pipes and having a floor surface at a lower level than connecting portions of the chamber connected to the inlet and outlet pipes, wherein the inlet and outlet pipes are horizontally connected to the chamber; and a recovery pipe connected to the chamber so as to extend downwardly therefrom, wherein the recovery pipe extends directly between the floor surface of the chamber and the inlet pipe, wherein the inlet pipe includes a horizontally extending portion and a vertically extending portion, wherein the recovery pipe extends at a downward decline at a predetermined angle from the vertically extending portion of the inlet pipe, and turns vertically upward so as to be connected to the floor surface of the chamber.

2. The accumulator as claimed in claim 1, wherein the outlet pipe is connected to the chamber in a state in which an end thereof is inserted in the chamber.

3. The accumulator as claimed in claim 2, wherein the end of the outlet pipe inserted in the chamber is bent upward.

4. The accumulator as claimed in claim 1, wherein a direction indicating line is provided on an outside of the chamber to indicate a flow direction of the refrigerant.

5. The accumulator as claimed in claim 1, wherein a central longitudinal axis of the chamber extends substantially horizontally.

6. The accumulator as claimed in claim 1, wherein a first end of the horizontally extending portion of the inlet pipe is connected to the chamber, and the vertically extending portion of the inlet pipe extends vertically from a second end of the horizontally extending portion.

7. The accumulator as claimed in claim 1, wherein the recovery pipe comprises:

a first portion having a first end connected to the vertically extending portion of the recovery pipe; and a second portion having a first end connected to a second end of the first portion of the recovery pipe, and a second end connected to the floor surface of the chamber, wherein the first portion extends at the downward decline at the predetermined angle from the vertically extending portion of the inlet pipe, and the second portion extends vertically upward from the second end of the first portion to the floor surface of the chamber.

8. A refrigeration cycle system comprising an accumulator, said accumulator installed between a compressor and an evaporator of said refrigeration cycle system, the accumulator comprising an inlet pipe through which a refrigerant is introduced from the evaporator; said inlet pipe connecting the evaporator and the accumulator; an outlet pipe through which the evaporated refrigerant is delivered to the compressor; said outlet pipe connecting the accumulator and the compressor; a chamber connected to the inlet and outlet pipes and having a floor surface at a lower level than connecting portions of the chamber connected to the inlet and outlet pipes, wherein the inlet and outlet pipes are horizontally connected to the chamber; and a recovery pipe connected to the chamber so as to extend downwardly therefrom, wherein the recovery pipe extends directly between the floor surface of the chamber and the inlet pipe, wherein the inlet pipe includes a horizontally extending portion and a vertically extending portion, wherein the recovery pipe extends at a downward decline at a predetermined angle from the vertically extending portion of the inlet pipe, and turns vertically upward so as to be connected to the floor surface of the chamber.

* * * * *